United States Patent [19]

Warren

[11] 4,416,745

[45] Nov. 22, 1983

[54] PROCESS FOR RECOVERING NICKEL FROM SPENT ELECTROLESS NICKEL PLATING SOLUTIONS

[75] Inventor: Gilbert G. Warren, Sidney, N.Y.

[73] Assignee: The Bendix Corporation, Southfield, Mich.

[21] Appl. No.: 353,772

[22] Filed: Mar. 1, 1982

[51] Int. Cl.[3] ..... C25C 1/08

[52] U.S. Cl. ..... 204/112

[58] Field of Search ..... 204/149, 112, 140, DIG. 13, 204/10, 49, 152

[56] References Cited

U.S. PATENT DOCUMENTS

| | | | |
|---|---|---|---|
| 2,233,103 | 2/1941 | Mantell | 204/10 |
| 2,365,356 | 12/1944 | Pilling et al. | 204/10 X |
| 3,458,407 | 7/1969 | Wrangell | 204/10 |
| 3,510,408 | 5/1970 | Murdock et al. | 204/10 |
| 4,127,458 | 11/1978 | MacGregor | 204/109 |
| 4,144,149 | 3/1979 | Bollhalder et al. | 204/149 |
| 4,162,950 | 7/1979 | MacGregor | 204/149 |

OTHER PUBLICATIONS

Mehl E., "Production of Metal Powders", *Metal Treatment and Drop Forging,* Summer 1950, pp. 118–127.

Walker et al., "Production of Metal Powders by Electro-Deposition", *Chemistry and Industry,* 6 Oct. 1979, pp. 642–647.

*Primary Examiner*—G. L. Kaplan
*Assistant Examiner*—T. L. Williams
*Attorney, Agent, or Firm*—William G. Kratz, Jr.; Raymond J. Eifler

[57] ABSTRACT

A process for recovering nickel from spent electroless nickel plating solutions by adjusting the pH of the solution to 10–10.5 with sodium hydroxide, adding ammonium hydroxide to obtain a pH of 11 of the solution, and heating the solution at 40°–50° C. while subjecting the solution to electrolysis to deposit nickel from the spent solution and separating the deposited nickel such that the spent solution may be safely discharged as effluent.

7 Claims, No Drawings

PROCESS FOR RECOVERING NICKEL FROM SPENT ELECTROLESS NICKEL PLATING SOLUTIONS

BACKGROUND OF THE INVENTION

This invention relates to a process for recovering nickel from spent electroless nickel plating solutions so as to permit safe disposition of such spent solutions.

Electroless nickel plating solutions are well known for use in plating nickel on to various substrates. Such solutions have relatively short lives and must frequently be discarded into waste disposal systems. The limits set by authorities for such nickel disposition are constantly being restricted such that removal of the vast majority of the nickel prior to disposition of spent solutions, as an effluent, is required.

There has been described in U.S. Pat. No. 4,144,149, entitled "Method for Working Up Aqueous Residues From Metallizing Baths", issued Mar. 13, 1979, a process for puifying electroless copper metalizing baths containing an amino compound, such as ethylenediaminetetraacetic acid (EDTA) where the bath is adjusted to a pH of 10–12 using sodium hydroxide or other inorganic base, and electrolyzing the basic solution using steel sheets as cathodes and platinum-coated titanium sheets as anodes. In that reference, after passage of a current for a period of time, the metal is separated, the solution acidified, and further electrolysis carried out on the acidified bath to eliminate the complexing ability of the amino compound. That reference is specific, however, to aqueous baths containing at least one organic amino compound such as EDTA or other organic amino complexing agent.

While some chemical methods have been proposed for removal of nickel from spent solutions, such methods are relatively inefficient, expensive, and often result in volumes of sludge which must then be further treated or taken to landfill systems.

It was believed by many that nickel could not be plated out of such spent solutions, and thus no effective means for removing nickel from such solutions prior to discharge as effluent was provided.

I have found, however, that by following specific process steps, according to the present invention, nickel can be effectively electrolyzed out of spent electroless nickel containing solutions both efficiently and inexpensively.

DISCLOSURE OF THE INVENTION

The present process provides the recovery of nickel from electroless nickel plating solutions to permit safe disposition of effluents from plating processes using electroless nickel plating. The invention is characterized by adding an inorganic base to adjust the pH of the spent solution to between 10–10.5, adding ammonium hydroxide to the basified solution to raise the pH thereof to at least 11.0, heating the ammonium hydroxide containing spent solution to a temperature of between 40°–50° C., and then subjecting the heated solution to electrolysis for a period of time to deposit nickel from the spent solution, such that the resulting solution may be safely disposed of as effluent.

Accordingly, it is one advantage of this invention to provide an electrolytic method for recovering nickel from spent electroless nickel plating solutions.

Another advantage of this invention is to provide a process for recovering nickel from electroless nickel plating solutions without producing large volumes of sludge materials such as result from chemical recovery methods.

A further advantage of this invention is to provide a method for treating electroless nickel plating solutions such that the treated solution may be safely discharged as effluent.

DETAILED DESCRIPTION OF THE INVENTION

The spent electroless nickel plating solutions from which nickel is recovered by the present process comprise those known solutions which result from electroless plating of substrates, wherein the plating solution does not contain amino complexing agents.

The electroless nickel plating solutions that, when spent, may be subject to the process of the present invention are those known and commercially available aqueous solutions which contain a nickel salt, such as nickel sulphate, a basic salt such as sodium hypophosphite, and an organic acid or salt such as lactic acid, citrates or sodium succinate, with a base such as ammonium hydroxide or sodium hydroxide normally added so as to adjust the pH to the desired level. Examples of commercially available such electroless plating solutions are those sold by Allied Kelite Corporation under the mark Niklad-794; by Shipley Co. Inc. under the name Niculoy-22; and by Enthone Inc. under the name Enplate Ni 410.

Such electroless nickel plating solutions generally have short lives and must be frequently discarded into waste disposal systems. The spent solutions, resulting from the plating of components such as electrically conductive devices, may contain about one ounce per gallon of nickel as metal and, as such, may not be discharged into normal effluent systems. According to the present process, such spent solutions are treated to remove a major portion of the nickel remaining in the solutions so that the treated solutions may be discharged into conventional effluent systems.

According to the present process, the spent solutions are basified with an inorganic base to a particular pH range, ammonium hydroxide added to further basify the solutions, the solution heated to a particular temperature range, and the basified, heated spent solution subjected to electrolysis to precipitate nickel therefrom.

The spent electroless nickel plating solution is initially placed into a plastic lined tank and an inorganic base added to the solution to adjust the pH of the spent electroless plating solution to a pH of between 10.0 to 10.5, preferably to a pH of 10.2. The preferred inorganic base to be added is sodium hydroxide, although potassium hydroxide may also be used. Stirring of the solution upon addition of the base should be effected until the base is completely dissolved.

To the basified spent electroless nickel plating there is then added ammonium hydroxide in an amount which will raise the pH of the solution to at least 11. Preferably the ammonium hydroxide is added to adjust the pH to 11.0. Although a higher pH would be operational, the addition of ammonium hydroxide such that an increase in pH much above 11 is achieved would only be wasteful of the ammonium hydroxide.

After addition of the ammonium hydroxide to the basified spent electroless plating solution, the solution is heated to a temperature range of 40°–50° C. and maintained at that temperature range while the solution is subjected to electrolysis. While the addition of the inorganic base to the spent electroless nickel plating solution will cause an increase in the temperature of the solution, the same must be heated in order to retain the solution within the desired temperature range during electrolysis.

The electrolysis is carried out by use of an anode such as platinized titanium sheets and a cathode which can be brass, steel or copper, with brass being preferred. An electrical current is passed through the solution at a current density of about 10–30 amperes/ft$^2$, preferably about 10 amperes/ft$^2$.

After electrolysis under these conditions for a period of about 24 hours, the nickel concentration of the solution will be decreased up to about 90%, while continued hydrolysis for an additional 12 hour period will remove substantially all of the nickel from the solution. The nickel is deposited on the cathodes by the electrolysis and the spent nickel solution separated therefrom.

EXAMPLE

There was added to 100 gallons of spent electroless nickel solution, containing about 4,260 ppm nickel, held in a plastic lined tank at room temperature, the solution resulting from nickel cladding of metallic substrates using Niklad-794 sold by Allied Kelite Corp., about 45 pounds of sodium hydroxide pellets, slowly and with stirring, until the pH of the spent solution reached 10.0. The solution was stirred until the sodium hydroxide was completely dissolved. There was then added to the solution about 5.3 gallons (20 liters) of aqueous $NH_4OH$ (conc. 28–30%) while stirring, until the pH of the solution reached 11.0. There were added to the solution pieces of brass, with the brass connected to the negative side of a rectifier. Platinized titanium anodes were also placed in the solution and connected to a positive side of the rectifier. The spent solution was then subjected to electrolysis by passing a current at 10 amperes/ft.$^2$, while maintaining the temperature of the solution between 40°–50° C. During the electrolysis, which was effected for a period of 24 hours, over 90% of the nickel metal in the solution was deposited on the brass pieces. The spent solution was found to contain about 100 ppm of nickel. An additional electrolysis under the above condition removed substantially all of the nickel from the solution.

Having described the invention, what is claimed is:

1. A process for recovering nickel from spent electroless nickel plating solutions comprising:

(a) adding an inorganic base, selected from the group consisting of sodium hydroxide and potassium hydroxide, to said spent solution to raise the pH thereof to between 10–10.5;

(b) then adding ammonium hydroxide to said spent solution, to which said inorganic base has been added, and at said pH to raise the pH thereof to at least 11;

(c) heating said ammonium hydroxide containing spent solution to a temperature of between 40°–50° C.;

(d) subjecting said heated ammonium hydroxide containing spent solution to electrolysis, at a current density of about 10–30 amperes/ft$^2$, for a period of time sufficient to deposit a major portion of the nickel from said spent solution; and (e) separating said spent solution from said deposit of nickel.

2. The process for recovering nickel from spent electroless nickel plating solutions as defined in claim 1 wherein said inorganic base is sodium hydroxide.

3. The process for recovering nickel from spent electroless nickel plating solutions as defined in claim 1 wherein said inorganic base is added to raise the pH of solution to between 10–10.2.

4. The process for recovering nickel from spent electroless nickel plating solutions as defined in claim 1 wherein said solution is maintained at a temperature of between 40°–50° C. during said electrolysis.

5. The process for recovering nickel from spent electroless nickel plating solutions as defined in claim 1 wherein said electrolysis is carried out for a period of time to recover at least 90% by weight of the nickel present in said spent electroless nickel plating solution.

6. The process for recovering nickel from spent electroless nickel plating solutions as defined in claim 1 wherein said electrolysis is carried out for a period of at least 24 hours.

7. A process for recovering nickel from spent electroless nickel plating solutions comprising:

(a) adding sodium hydroxide to said spent solution to raise the pH thereof to between 10–10.2;

(b) then adding ammonium hydroxide to said spent solution, to which said sodium hydroxide has been added, at said pH to raise the pH thereof to about 11;

(c) heating said ammonium hydroxide containing spent solution to a temperature of between 40°–50° C.;

(d) subjecting said heated ammonium hydroxide containing spent solution to electrolysis, at a current density of about 10–30 amperes/ft$^2$, for a period of time sufficient to deposit a major portion of the nickel from said spent solution; and (e) separating said spent solution from said deposit of nickel.

* * * * *